US005596771A

United States Patent [19]

Hsu et al.

[11] Patent Number: 5,596,771

[45] Date of Patent: Jan. 28, 1997

[54] SWIM GOGGLES WITH NESTED TYPE OF HEAD BAND FASTENING MEANS

[75] Inventors: Chao-Chin Hsu, T'ai Nan; Ruey B. You, Taipei, both of Taiwan

[73] Assignee: Industrial Technology Research Institute, Hsinch, Taiwan

[21] Appl. No.: 551,792

[22] Filed: Nov. 7, 1995

[51] Int. Cl.[6] ..... A61F 9/02

[52] U.S. Cl. ..... 2/428; 2/452

[58] Field of Search ..... 2/428, 429, 430, 2/452, 447; 351/43

[56] References Cited

U.S. PATENT DOCUMENTS

| | | | |
|---|---|---|---|
| 4,348,775 | 9/1982 | Haslbeck | 2/452 |
| 4,564,960 | 1/1986 | Nishiyama | 2/452 |
| 4,930,885 | 6/1990 | Laschober | 2/452 X |
| 5,181,280 | 1/1993 | Zachry, Jr. | 2/452 |
| 5,459,882 | 10/1995 | Yamamoto | 2/428 |

*Primary Examiner*—Peter Nerbun

*Attorney, Agent, or Firm*—W. Wayne Liauh

[57] ABSTRACT

A pair of swim goggles with nested type head band fastening structure is disclosed. It comprises: (a) a head band; (b) two goggles, each of the goggles being provided at an outer front corner with a recess which has a long slot formed at a rear wall thereof; (c) two fastening means; each of the fastening means being provided at a front surface with a vertically extending central bar, and the fastening means having a contour which permits the fastening means to nest in the recess of the goggle. The front surface of the fastening means is substantially flush with the outer surface of the goggle so as to provide the swim goggle with an integrated and smooth appearance. In a preferred embodiment, the head band has two free ends which respectively pass through the long slots of the recesses on the goggles, return about the central bars of the fastening means, and then pass through the long slots of the recesses again so as to be fixed thereto. The fastening means and the recesses are dimensioned such that the fastening means can be removably pressed into the recesses, so as to cause the fastening means to be firmly nested inside the recesses, respectively.

2 Claims, 6 Drawing Sheets

SWIM GOGGLES WITH NESTED TYPE OF HEAD BAND FASTENING MEANS

BACKGROUND OF THE INVENTION

1. Field of the Invention

The present invention relates to swim goggles with nested type of head band fastening means, and more particularly to swim goggles with nested type of head band fastening means that have an integrated and smooth appearance and can be more safely and comfortably worn by a user.

2. Description of the Prior Art

FIG. 1 illustrates a pair of swim goggles and a head band connected together in a most common manner. U.S. Pat. No. 3,944,345 discloses swim goggles and head band connected to each other in such manner. In the figure, the goggles 10 are provided with a rectangular opening 11 at each lateral end for the head band 14 to thread through. And, two buckles 12 formed with two rectangular openings 13 are used to tightly fix the free ends of the head band 14. The buckles 12 tend to uncomfortably contact with or even scrape the wearer's face. Moreover, the buckles 12 attached to the head band 14 would somewhat adversely affect the esthetic appearance of the head band 14.

FIG. 2 illustrates another very common manner in which a head band is connected to a pair of swim goggles. U.S. Pat. No. 5,129,109 discloses swim goggles and head band connected to each other in such manner. In FIG. 2, goggles 20 are directly molded with two buckles 12 at two lateral ends thereof. The buckles 20 each have two rectangular openings 21 for a free end of a head band 22 to extend through and be fixed thereto. The rectangular openings 21 must have adequate width lest the head band 22 should come loose therefrom. However, even if the rectangular openings 21 have adequate width, it is necessary to turn the goggles a couple of times when the wearer tries to thread the head band 22 through the rectangular openings. This is of course very inconvenient to the wearer.

U.S. Pat. No. 5,303,428 discloses a head band fastener with four buckles which is complicated in structure and is therefore inconvenient to assemble.

SUMMARY OF THE INVENTION

It is a primary object of the present invention to provide swim goggles with nested type of head band fastening means. The fastening means can be fitly nested in recesses formed on the goggles, forming an integral part of the goggles and giving the goggles a beautiful and integrated appearance.

Another object of the present invention is to provide swim goggles with nested type of head band fastening means in which the fastening means are fitly nested in recesses formed on the goggles without leaving any opening on the goggles and the head band needs not any other buckle or fastening means attached to it. The goggles and head band fastening means, according to the present invention, can therefore reduce the turbulence in water caused by any opening on the goggles and/or any buckle on the head band.

A further object of the present invention is to provide swim goggles with nested type of head band fastening means in which the fastening means would not contact the wearer's face so that the swim goggles can be more safely and comfortably used.

DETAILED DESCRIPTION OF THE PREFERRED EMBODIMENTS

Figure 1:
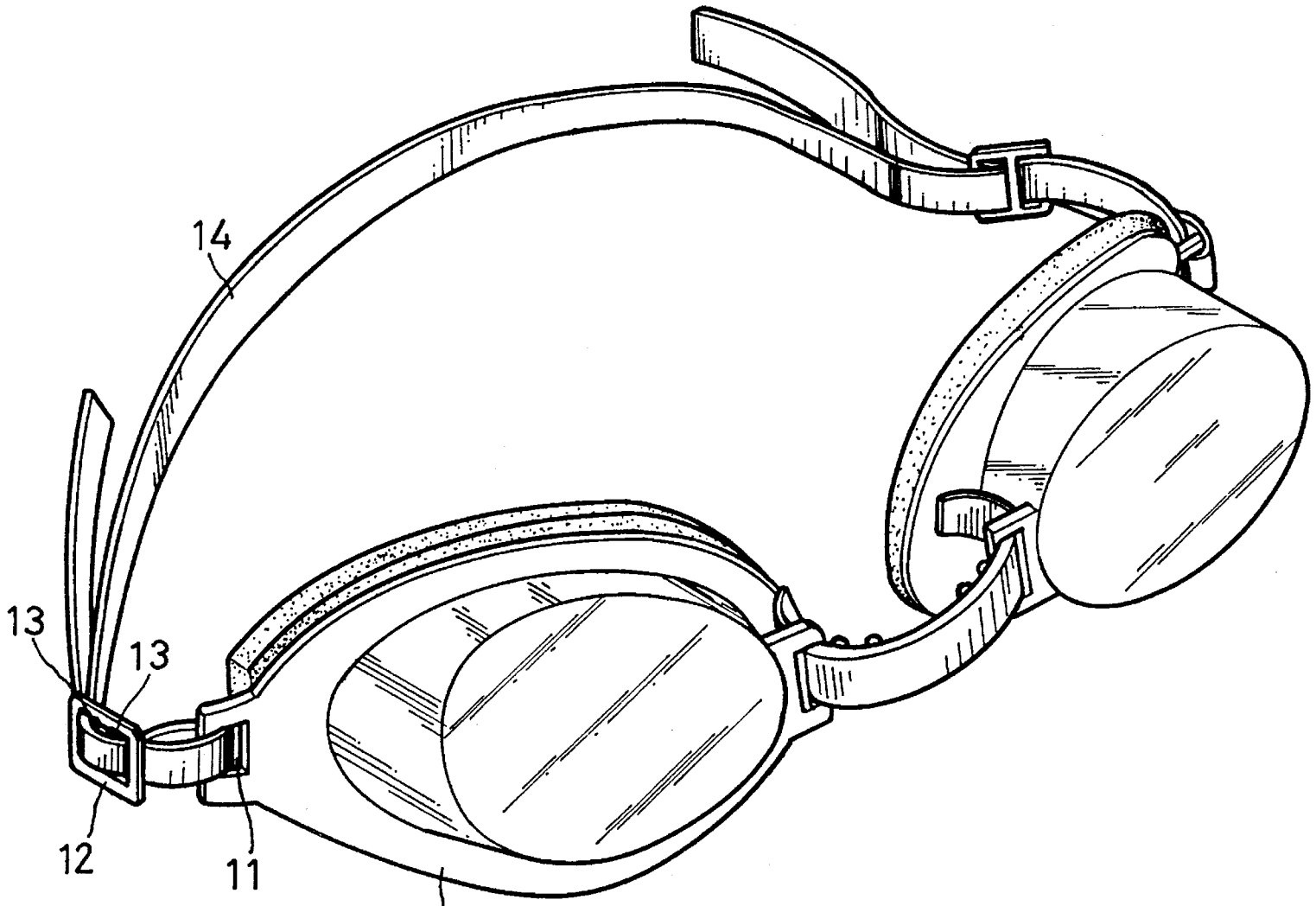
FIG. 1 (PRIOR ART)
FIG. 1 illustrates a first example of conventional manner in which a head band is connected to a pair of swim goggles.
Figure 2:
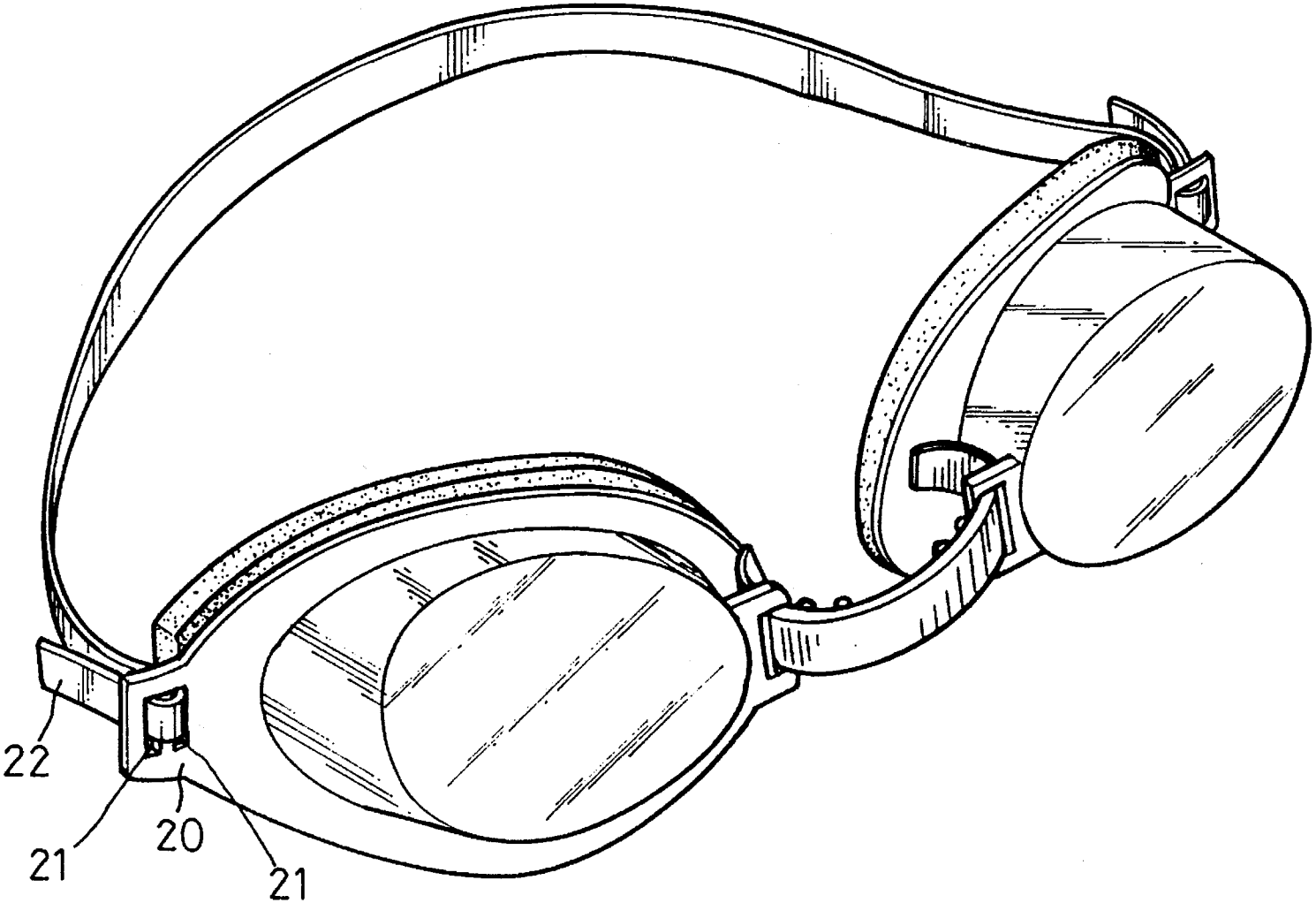
FIG. 2 (PRIOR ART)
FIG. 2 illustrates a second example of conventional manner in which a head band is connected to a pair of swim goggles.
Figure 3:
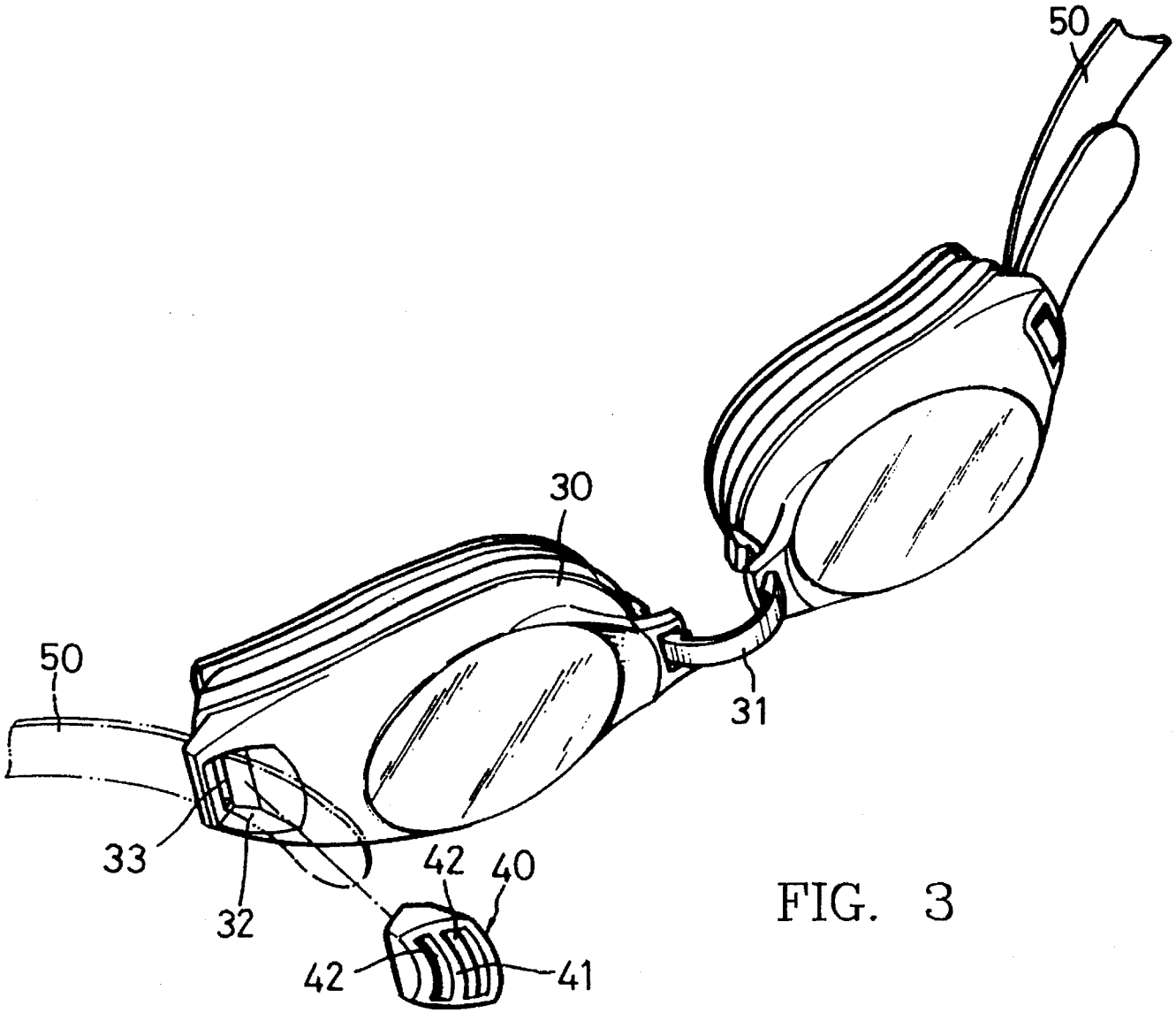
FIG. 3 is an exploded perspective showing a first embodiment of the present invention.
Figure 4:
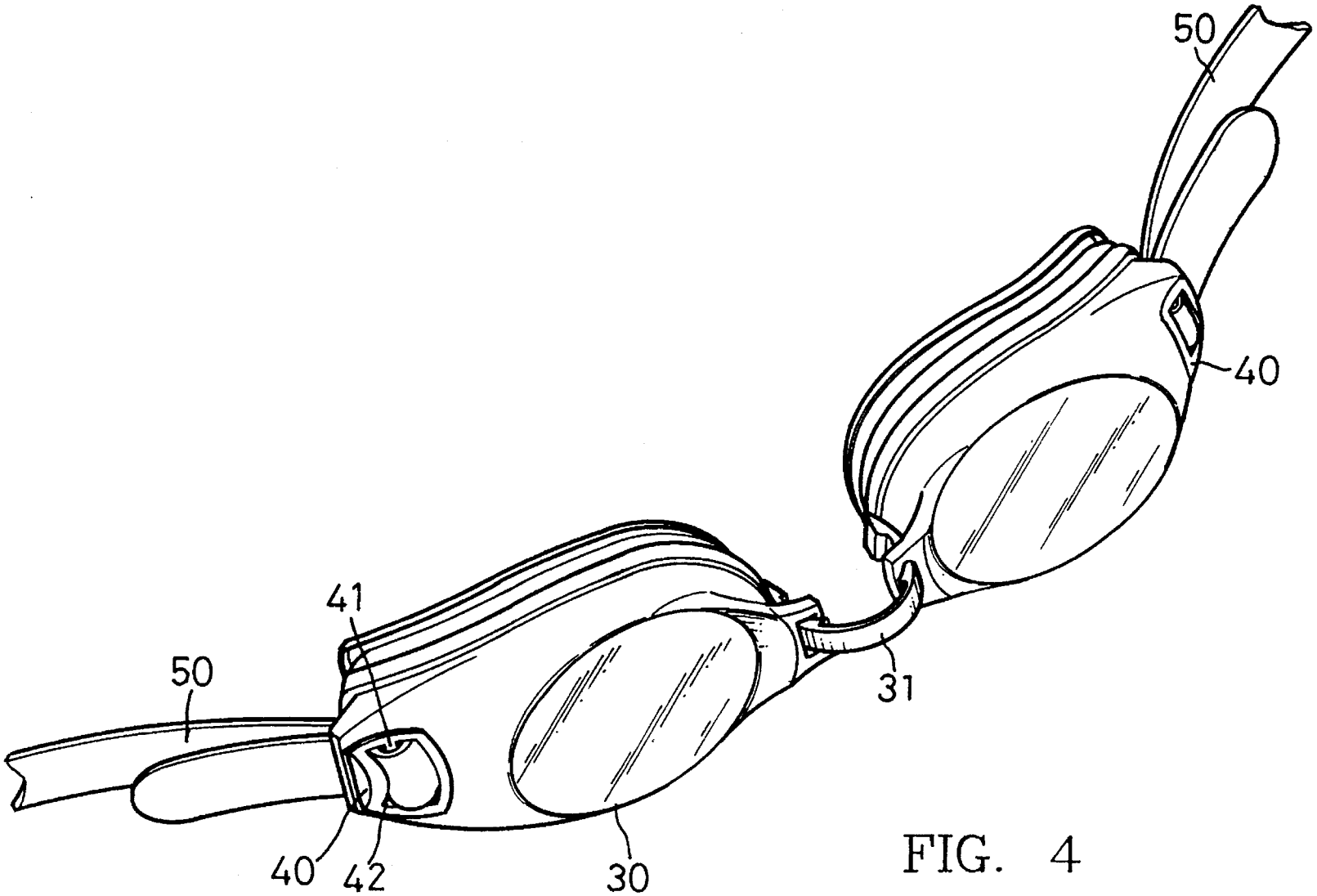
FIG. 4 is an assembled perspective showing the first embodiment of the present invention.
Figure 5:
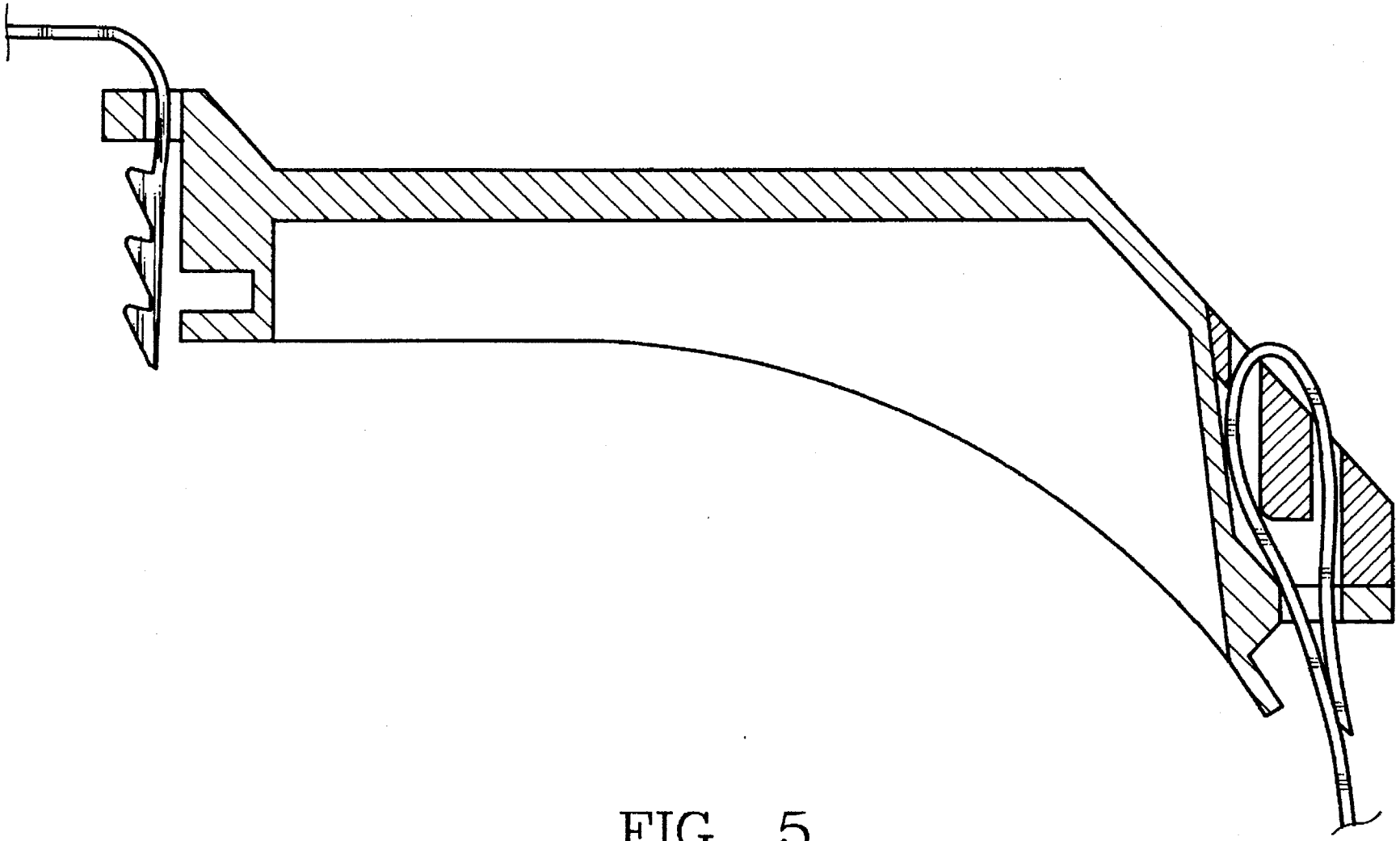
FIG. 5 is a fragmentary, enlarged sectional view showing the assembling of the goggle, the fastening means, and the head band of the first embodiment of the present invention.

Please refer to FIGS. 3, 4, and 5. The present invention includes two swim goggles 30 connected to each other by a nose bridge 31, two fastening means 40, and a head band 50. Each goggle 30 is provided at an outer front corner with a recess 32. A rectangular slot 33 is formed at a rear wall of the recess 32. The fastening means 40 has a central bar 41 vertically crossing a front surface thereof, forming two vertically extended rectangular openings 42 at each side of the central bar 41. The fastening means 40 has a contour which permits the fastening means 40 to fit into the recess 32 of the goggle 30 with the front surface of the fastening means 40 completely flushing with a front surface of the goggle 30. The head band 50 is connected to the goggles 30 and the fastening means 40 by extending its respective free end through the slot 33 on the rear wall of the recess 32 at the outer front corner of the goggle 30, and then through one of the openings 42 at an inner position. The free end of the head band 50 turns back about the central bar 41 to extend into and through the other opening 42 at an outer position to pass through the slot 33 again and be tightly fixed thereto.

The rectangular slot 33 of the recess 32 on the goggle 30 shall apply a pressure against the two portions of head band 50 passing through the slot 33 so that the head band 50 is tightly retained thereto without the risk of coming loose.

When the swim goggles 30 are worn by a user, the head band 50 shall pull the two fastening means 40 backward, causing the fastening means 40 to be nested in the recesses 32 in a completely fitted and more desirable manner. After the fastening means 40 are positioned in the recesses 32, they will not easily move out of the recesses 32 due to the pressure applying by the slots 33 on the portions of the head band 50 passing therethrough.

To adjust the head band 50 to a suitable length, first remove a fastening means 40 from the recess 32. When the head band 50 has been adjusted to a desired length with the free end thereof being routed in the manner as described above, pull the free end of the head band 50 backward until the fastening means 40 is completely nested in the recess 32 again.

After the fastening means 40 of the present invention are positioned in the recesses 32, their front surface will be flush with the outer surface of the goggles 30, leaving no gap between the goggles 30 and the fastening means 40. With this special design, the user wearing the swim goggles of the present invention may swim at a higher speed because the possible water resistance and turbulence is reduced.

Figure 6:
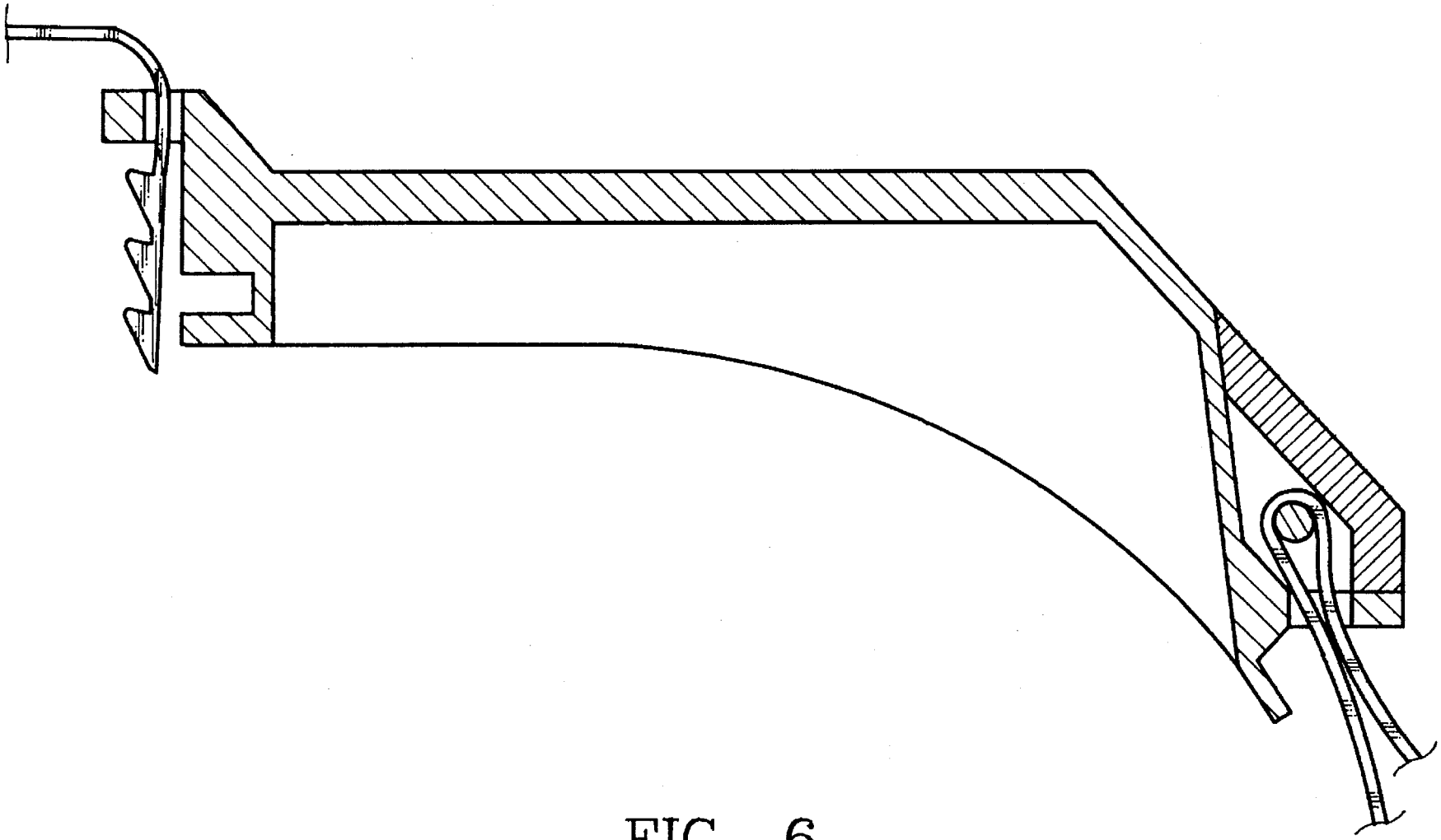
FIG. 6 is also a fragmentary, enlarged sectional view showing the assembling of the goggle, the fastening means, and the head band of a second embodiment of the present invention.

FIG. 6 illustrates another embodiment of the present invention. A fastening means 43, according to this embodiment, has a front surface 44 without any opening which will be flush with the outer surface of goggle 30 when the fastening means 43 is engaged into the recess 32 formed on the goggle 30, giving the goggle 30 a completely smooth outer surface. The fastening means 43 is provided behind the front surface 44 with a vertically extended rod 45. A free end of the head band 50 passes through the slot 33 and winds about the rod 45 to turn back to the slot 33 again and be fixed thereto.

The fastening means 40 or 43 of the present invention are firmly nested in the goggles 30 without contact with the user's face. So, the present invention will not injure or cause discomfort to the user.

The fastening means 40 or 43 have a front surface being flush with the outer surface of the goggles 30 and therefore giving the goggles 30 an integrated, smooth, and beautiful appearance. Moreover, the lens used together with the swim goggles 30 can be a non-spherical lens (which has long been adopted by general reading glasses with plastic lens) so that a myopic swimmer may use such goggles to see more clearly under water.

What is claimed is:

1. A pair of swim goggles with nested type of head band fastening structure, comprising:

(a) a head band;

(b) two goggles; each of said goggles being provided at an outer front corner with a recess which has a long slot formed at a rear wall thereof;

(c) two fastening means; each of said fastening means being provided at a front surface with a vertically extending central bar, and said fastening means having a contour which permits said fastening means to nest in said recess of said goggle with a front surface of said fastening means which is substantially flush with an outer surface of said goggle to provide said swim goggle with an integrated and smooth appearance;

(d) wherein said head band has two free ends which respectively pass through said long slots of said recesses on said goggles, return about said central bars of said fastening means, and then pass through said long slots of said recesses again so as to be fixed thereto.

2. The pair of swim goggles with nested type of head band fastening structure according to claim 1 wherein said fastening means and said recesses are dimensioned such that said fastening means can be removably pressed into said recesses, respectively, so as to cause said fastening means to be firmly nested inside said recesses.

* * * * *